United States Patent [19]

Oehy

[11] Patent Number: 4,497,087

[45] Date of Patent: Feb. 5, 1985

[54] APPARATUS FOR CUTTING A FIBER SLIVER

[75] Inventor: Peter Oehy, Winterthur, Switzerland

[73] Assignee: Rieter Machine Works, Winterthur, Switzerland

[21] Appl. No.: 500,994

[22] Filed: Jun. 3, 1983

[30] Foreign Application Priority Data

Jun. 8, 1982 [CH] Switzerland ..... 3519/82

[51] Int. Cl.[3] ..... B65H 54/80

[52] U.S. Cl. ..... 19/159 A

[58] Field of Search ..... 19/159 R, 159 A

[56] References Cited

U.S. PATENT DOCUMENTS

| | | | |
|---|---|---|---|
| 3,354,513 | 11/1967 | Fornes | 19/159 A |
| 3,381,342 | 5/1968 | Selby et al. | 19/159 A |
| 3,386,134 | 6/1968 | Munroe et al. | 19/159 A |
| 3,435,485 | 4/1969 | Stiepel | 19/159 R |
| 3,605,198 | 9/1971 | Mackie | 19/159 A |
| 4,033,104 | 7/1977 | Kamp | 19/159 A |

FOREIGN PATENT DOCUMENTS 2204562 5/1974 France .

*Primary Examiner*—Louis K. Rimrodt
*Attorney, Agent, or Firm*—Kenyon & Kenyon

[57] ABSTRACT

The can filling station is provided with can removal means for moving full cans away from a filling position. A sliver separator is also mounted on the can removal means to engage against the underside of the coiler guide wheel under a spring biased force. Simultaneously with the movement of the full can, the separator slides over the exit opening of the sliver channel in the guide wheel and thus separates or tears the fiber sliver which is stationary and located in the exit opening.

17 Claims, 4 Drawing Figures

APPARATUS FOR CUTTING A FIBER SLIVER

This invention relates to apparatus for cutting a fiber sliver. More particularly, this invention relates to apparatus for cutting a fiber sliver delivered into a can in a can filling station.

Heretofore, it has been known to fill a series of cans with fiber sliver which is delivered from a delivery means such as a coiler guide wheel. In many cases, attempts have been made to sequentially fill the cans in an automated manner. However, to do so has required a cutting of the fiber sliver which has been delivered into a filled can so that the next can in the series can be filled. For example, as described in U.S. Pat. No. 3,605,198, it has been known to provide a device for the automatic changing of cans in which a fiber sliver is held by a pivotal double-arm and is cut by means of a pivoting movement of two levers in a direction transverse to the fiber sliver. However, this device has certain disadvantages. For example, an extensive mechanism is required. Further, the can change must be completed before the sliver can be cut.

It has also been known from U.S. Pat. No. 3,354,513 to utilize a shears which is automatically operable by a power means in order to cut a sliver suspended between the delivery means and a shifted full can. However, such a construction has the same disadvantages as the device described in U.S. Pat No. 3,605,198.

It has also been known from U.S. Pat. No. 3,381,342 to provide a fiber sliver cutting device in which, after completion of a can change, the fiber sliver is gripped by a pneumatically moveable gripper and brought against a cutting means which is moveable in the opposite direction and which is operated by the gripper. However, as above, this requires an extensive mechanism and a complete can change before cutting of the sliver.

Accordingly, it is an object of the invention to provide a relatively simple apparatus for cutting a sliver which is fed into a series of cans.

It is another object of the invention to provide a simple sliver cutting device which is operable simultaneously with a can change.

Briefly, the invention provides a cutting apparatus for use with a coiler guide wheel having a fiber sliver channel for delivering a continuous length of fiber sliver. The cutting apparatus includes a sliver separator and means for moving the sliver separator across the fiber sliver channel while in contact with an underside of the coiler guide wheel in order to cut a fiber sliver extending therefrom.

The cutting apparatus also cooperates with a can removal means which serves to move a can from below the coiler guide wheel. In this case, the sliver separator is coupled with the can removal means for movement therewith.

In use, the sliver separator is moveable during removal of a full can and follows after the can substantially synchronously with the removal movement of the can. At the same time, the sliver separator moves in contact with an underside of the coiler guide wheel under a predetermined contact pressure while seating over the sliver channel in order to cut the fiber sliver. In this regard, the sliver which extends from the channel is cut within a length of movement of the sliver separator from the channel corresponding to at least double the length of the longest fiber in the sliver.

One advantage of the cutting apparatus is that the sliver cutting can be carried out simultaneously with the exchange of a full can for an empty can. Another advantage is that the cutting apparatus is simply constructed both structurally and functionally.

In one embodiment, the sliver separator can be mounted on a travelling frame so as to move rectilinearly relative to the coiler guide wheel. In another embodiment, the sliver separator is supported on a rotary column for pivoting about the column relative to the coiler guide wheel.

Suitable spring biasing means may also be provided for biasing the sliver separator against the underside of the coiler guide wheel in order to provide a predetermined force.

The sliver separator can be pivotally mounted in order to adapt to the underside of the coiler guide wheel. In addition, the sliver separator is constructed with a sliding element of plastics material for abutting the underside of the coiler guide wheel.

These and other objects and advantages of the invention will become more apparent from the following detailed description taken in conjunction with the accompanying drawings wherein.

Figure 1:
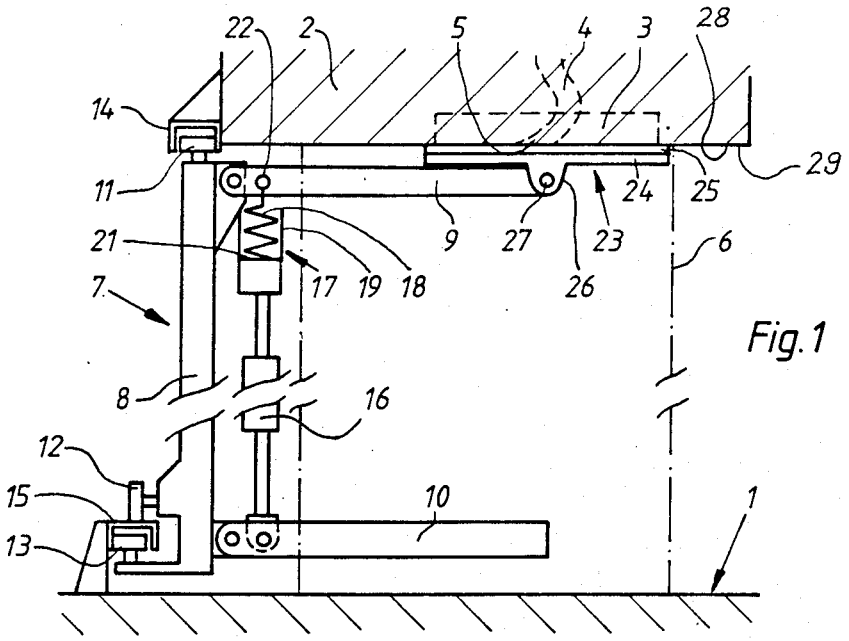
FIG. 1 illustrates a side view of a can filling station employing a cutting apparatus in accordance with the invention.
Figure 2:
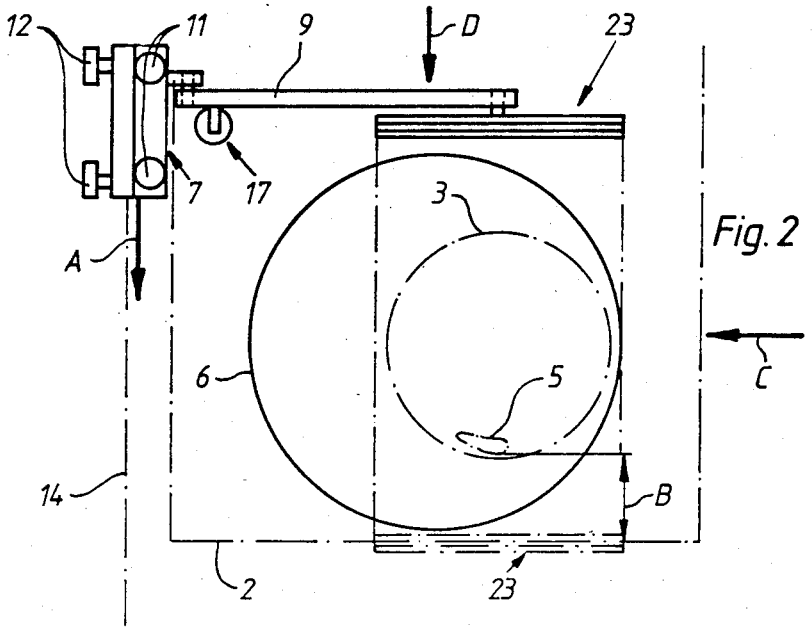
FIG. 2 illustrates a top view of the cutting station of FIG. 1.

Referring to FIGS. 1 and 2, the can filling station is provided with a floor portion 1 for supporting a can 6 thereon as well as a head portion 2 above the floor portion 1. In addition, a coiler guide wheel 3 is rotatably supported in the head portion 2. This guide wheel 3 has a fiber sliver channel 4 (indicated in dotted lines) for delivering a continuous length of fiber sliver through an exit opening 5.

The coiler guide wheel 3 operates in known fashion so that a sliver can be coiled into the can 6.

A can removal means 7 is also provided for moving the can 6 when filled from below the guide wheel 3 and from the filling station. This can removal means 7 includes a travelling frame 8 and a can mover 10 which is pivotally mounted on the frame 8. As shown, the travelling frame 8 is guided on via rollers 11, 12, 13 on rails 14, 15 so as to move rectilinearly relative to the guide wheel 3.

In addition, a cutting apparatus is supported on the travelling frame 8. This cutting apparatus includes a sliver separator 23 and means for moving the sliver separator 23 below and across the coiler guide wheel 3. The means for moving the sliver separator 23 includes an arm 9 which supports the sliver separator 23 at one end and which is pivotally mounted on the frame 8 at the opposite end. In addition, a power means 16 in the form of a double acting pneumatic cylinder is provided for moving the arm 9 relative to the guide wheel 3, i.e. in a vertical plane. As such, the cylinder 16 also acts as a means for lifting the separator 23 away from an underside 28 of the guide wheel 3. A spring 17 is also connected to and between the arm 9 and the power means 16 for biasing the sliver separator 23 against the coiler guide wheel 3 under a predetermined force. As shown, the power means 16 is also pivotally connected to the can mover 10 in order to pivot the can mover 10 simultaneously with the arm 9.

As indicated in FIG. 1, the spring 17 is in the form of a helical spring 18 which can be loaded in tension and compression. This helical spring 18 is guided against transverse distortion in a sleeve 19 in such a manner that the spring coils are slideably guided on the internal wall of the sleeve 19. The sleeve 19 is, in turn, connected with a piston rod of the cylinder 16. As indicated, one end of the helical spring 18 is fixed to the end of the sleeve 19 while the opposite end is pivotally connected to the arm 9 via a pin joint 22.

The sliver sepatator 23 is constructed of a holder 24 and a sliding element of plastics material in the form of a separator lip 25, for example of polyurethane. This separator lip 25 is fixedly secured to the holder 24. In addition, the holder 24 has a socket portion 26 which is mounted on a pin 27 on the arm 9 so as to effect a pivotal connection of the separator 23 with the arm 9. The pivotal nature of the mounting of the separator 23 on the arm permits an exact engagement of the separator 23 with an underside 29 of the head portion 2 which underside is flush with the underside 28 of the coiler guide wheel 3.

The friction between the pin 27 and the socket 26 is such that the position of the sliver separator 23 relative to the arm 9 does not change during pivoting from the operating condition illustrated in FIG. 2 into a substantially vertical initial condition (not shown).

Cutting of the fiber sliver occurs in the following manner.

After a can 6 has reached the required degree of filling, the pneumatic cylinder 16 is operated so that the mover 10 and the arm 9 move out of an initial vertical condition into the operating condition illustrated in FIGS. 1 and 2. In this condition, the separator lip 25 engages the underside 29 of the head portion 2 under the bias of the spring 17.

Next, the travelling frame 8 is shifted in the direction indicated by the arrow A as shown in FIG. 2, so that the mover 10 engages and pushes the full can 6 away out of the can filling station in the direction of the arrow A. As a result, the separator lip 25 which is synchronized to move with the can 6 catches the now stationary fiber sliver at the exit opening 5 of the fiber sliver channel 4 and tears the fiber sliver by means of this grazing movement within a length of movement B which corresponds to at least double the length of the longest fiber in the sliver. The minimum can removal distance must therefore be so chosen that this condition is fulfilled.

After the full can 6 has reached a next function position outside the can filling station, the pneumatic cylinder 16 is operated again so that the mover 10 and the arm 9 pivot back into the initial vertical condition. Thereupon, the frame 8 travels back again into the initial condition illustrated in FIGS. 1 and 2. In the interim, an empty can is brought either from the direction C or from the direction D into the can filling position. The can filling procedure can thereafter be restarted.

Figure 3:
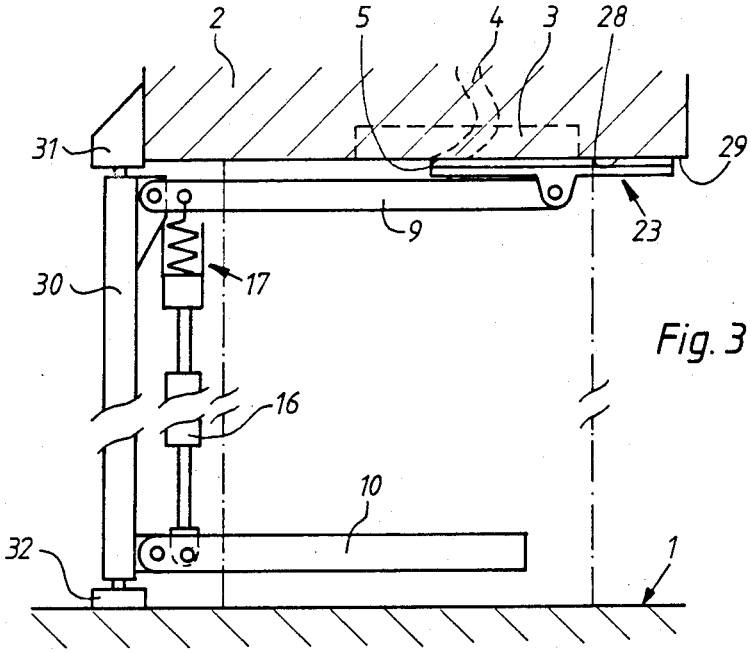
FIG. 3 illustrates a side view of a can filling station employing a modified cutting apparatus in accordance with the invention.
Figure 4:
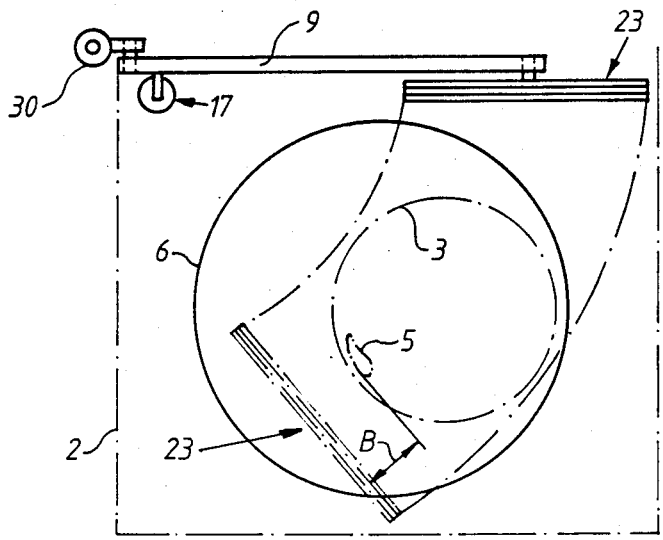
FIG. 4 illustrates a top view of the can filling station of FIG. 2.

Referring to FIGS. 3 and 4, wherein like reference characters indicate like parts as above, the can removal and therefore, the sliver cutting can be carried out in a circular movement rather than a rectilinear movement. In this regard, the arm 9 and can mover 10 are pivotally mounted on a rotary column 30. As shown, the column 30 is rotatably supported in a bearing 31 secured to the head portion 2 and in a bearing 32 forming part of the floor portion 1.

In use, during a can removal, the arm 9 must be pivoted past the exit opening 5 of the sliver channel 4 over a distance B (see FIG. 4) which corresponds to at least double the length of the longest fiber in the sliver.

Of note, the position of the stopped exit opening 5 within the way of the circular movement of the opening 5 need not be such that the exit opening 5 is limited to a position within that way provided the conditions relating to the distance B are satisfied.

Of further note, the means for moving the travelling frame 8 and the rotary column 3 can be effected by a suitable drive with a corresponding control system (not shown). Further description of such a construction is not required for an understanding of the operation of the cutting apparatus.

The invention thus provides a sliver cutting apparatus which can be easily incorporated into a can filling station for cooperation with a coiler guide wheel. Further, the cutting apparatus is able to effect cutting of a sliver during a can exchanging operation.

With the cutting apparatus operated in conjunction with the can mover, both the sliver separator and can mover can be pivoted into a vertical plane for return passage past an empty can which has been set into the can filling station.

What is claimed is:

1. In combination, a coiler guide wheel having a fiber sliver channel for delivering a continuous length of fiber sliver into a can in a can filling station;

means for moving the can from said filling station; and a cutting apparatus including a sliver separator, and means for moving said sliver separator below and across said fiber sliver channel while in contact with an underside of said coiler guide wheel to cut a fiber sliver extending from said channel within a length of movement from said channel corresponding to at least double the length of the longest fiber in the sliver; the movement of said sliver separator being synchronized with the movement of the can from said filling station.

2. The combination as set forth in claim 1 which further comprises means for lifting said sliver separator away from said underside of said coiler guide wheel.

3. The combination as set forth in claim 1 wherein said means includes an arm supporting said sliver separator thereon, a power means for moving said arm relative to said coiler guide wheel, and a spring connected to and between said arm and said power means for biasing said sliver separator against said coiler guide wheel under a predetermined force.

4. The combination as set forth in claim 1 which further comprises can removal means for moving a can from below said coiler guide wheel and wherein said sliver separator is coupled with said can removal means for movement therewith.

5. The combination as set forth in claim 1 wherein said sliver separator includes a sliding element of plastics material for abutting said coiler guide wheel underside.

6. A can filling station comprising a floor portion for supporting a can thereon;

a head portion above said floor portion;

a coiler guide wheel rotatably supported in said head portion, said guide wheel having a channel therein for delivering a continuous length of fiber sliver into a can on said floor portion;

a sliver separator; and means for moving said sliver separator across said channel and in contact with said guide wheel to cut a fiber sliver extending from said channel to the can upon movement of the can from under said guide wheel.

7. A can filling station as set forth in claim 6 which further comprises can removal means for moving a can from below said coiler guide wheel.

8. A can filling station as set forth in claim 7 wherein said sliver separator is coupled with said can removal means for movement therewith.

9. In combination a coiler guide wheel having a fiber sliver channel for delivering a continuous length of fiber sliver; and a cutting apparatus including a pivotally mounted sliver separator, and means for moving said sliver separator across said fiber sliver channel while in contact with an underside of said coiler guide wheel to cut a fiber sliver extending therefrom.

10. The combination as set forth in claim 9 wherein said means includes an arm pivotally supporting said sliver separator thereon, a travelling frame supporting said arm thereon and rails for guiding said travelling frame rectilinearly relative to said guide wheel.

11. The combination as set forth in claim 10 which further comprises a can mover pivotally mounted on said frame for engaging and pushing a can from under said guide wheel.

12. The combination as set forth in claim 11 which further comprises a double acting cylinder connected to and between said arm and said can mover to pivot said arm and said can mover in a vertical plane.

13. The combination as set forth in claim 12 which further comprises a spring between said cylinder and said arm for biasing said separator against said guide wheel under a predetermined force.

14. The combination as set forth in claim 9 wherein said means includes an arm pivotally supporting said sliver separator thereon and a rotary column supporting said arm for pivoting about said column relative to said guide wheel.

15. The combination as set forth in claim 14 which further comprises a can mover pivotally mounted on said column for engaging and pushing a can from under said guide wheel.

16. The combination as set forth in claim 15 which further comprises a double acting cylinder connected to and between said arm and said can mover to pivot said arm and said can mover in a vertical plane.

17. The combination as set forth in claim 16 which further comprises a spring between said cylinder and said arm for biasing said separator against said guide wheel under a predetermined force.

* * * * *